US006546672B2

(12) United States Patent
Tatsumi et al.

(10) Patent No.: US 6,546,672 B2
(45) Date of Patent: Apr. 15, 2003

(54) CABLE GUIDE STRUCTURE FOR WINDOW REGULATOR

(75) Inventors: Hisato Tatsumi, Kanagawa (JP); Yasuo Otsuki, Kanagawa (JP); Syunsuke Tamura, Kanagawa (JP)

(73) Assignee: Ohi Seisakusho Co., Ltd., Yokohama (JP)

( * ) Notice: Subject to any disclaimer, the term of this patent is extended or adjusted under 35 U.S.C. 154(b) by 0 days.

(21) Appl. No.: 09/985,803

(22) Filed: Nov. 6, 2001

(65) Prior Publication Data

US 2002/0053168 A1 May 9, 2002

(30) Foreign Application Priority Data

Nov. 9, 2000 (JP) ..... 2000-341913

(51) Int. Cl.[7] ..... E05F 11/48
(52) U.S. Cl. ..... 49/352
(58) Field of Search ..... 49/348, 349, 352, 49/502; 296/146.5

(56) References Cited

U.S. PATENT DOCUMENTS 5,632,121 A * 5/1997 Handte et al. ..... 49/352
5,960,588 A * 10/1999 Wurm et al. ..... 49/352
6,354,652 B1 * 3/2002 Arquevaux et al. ..... 49/352
6,397,524 B1 * 6/2002 Sakaguchi et al. ..... 49/352

* cited by examiner

*Primary Examiner*—Jerry Redman
(74) *Attorney, Agent, or Firm*—Foley & Lardner

(57) ABSTRACT

A cable guide structure for a window regulator is provided with rails aligned so as to be parallel with each other, moving elements for supporting a window panel, a cable connected to said moving elements. A diagonally cabling portion of the cable is linearly arranged. The directions of tangent lines of the pulleys at contact points of rail cabling portions with cable guide grooves coincide with axial directions of a cable in the rail cabling portions respectively. Further the directions of tangent lines of pulleys at contact points of the diagonally cabling portion with the cable guide grooves coincide with an axial direction of the cable in the diagonally cabling portion.

3 Claims, 7 Drawing Sheets

CABLE GUIDE STRUCTURE FOR WINDOW REGULATOR

CROSS REFERENCE TO RELATED APPLICATION

The present invention is based on Japanese Patent Application No. 2000-341913, the entire contents of which are incorporated herein by reference.

BACKGROUND OF THE INVENTION

1. Field of the Invention

The present invention relates to a cable guide structure for a window regulator, and more specifically to a cable guide structure for a window regulator having pulleys, which are rotatably provided at end portions of two rails and guide a cable looped thereover like a X-shape.

2. Description of the Related Art

Hitherto, there has been known a cable window regulator W of a configuration in which a window panel P is moved up and down by setting a loop consisting of cables R, which is endlessly guided over a pair of pulleys 101 and 101*a* respectively mounted on top and bottom portions of a front-side rail 100 and over a pair of pulleys 103*a* and 103 respectively mounted on top and bottom portions of a rear-side rail 102, so that the cables R extend along the rails 100 and 102 and wind around the pulleys 101, 103, 103*a* and 101*a* and cross each other like a X-shape, as illustrated in FIG. 6. Such rails 100 and 102 are formed in such a manner as to be laterally curved along an outer panel (not shown) of a door F, as viewed in this figure. Pulley mounting surfaces 10*a* and 102*a* respectively provided at the top portion of the rail 100 and the bottom portion of the rail 102 are inclined to an imaginary linear reference plane connecting the top portion of the rail 100 and the bottom portion of the rail 102 to each other. Moving elements 104 and 106 support the window panel P and are respectively provided on the rails 100 and 102 in such a way as to freely move up and down.

Here, parts 105 of the loop consisting of the cables R are respectively arranged between a pair of pulleys 101 and 101*a* and between a pair of pulleys 103 and 103*a* and referred to as rail cabling portions. Moreover, another part 107 of the loop consisting of the cables R is linearly arranged between the pulley 101 disposed at the top portion of the front-side rail 100 and the pulley 103 disposed at the bottom portion of the rear-side rail 102, and referred to as a first diagonally cabling portion. Furthermore, another part 108 of the loop consisting of the cable R is slacked and arranged between the pulley 101*a* provided on the bottom portion of the front-side rail 100 and referred to as a second diagonally cabling portion. A drive unit K is connected to a halfway part of the second diagonally cabling portion 108.

However, as illustrated in FIG. 7, the first diagonally cabling portion 107 is linearly arranged in such a conventional structure, as described above. Thus, the first diagonally cabling portion 107 is arranged so that the direction of an axis thereof differs from a guiding direction extending along each of the planes of rotation of the pulleys 101 and 103. Thus, there are fears that the first diagonally cabling portion 107 of the cable R comes in contact with each of edge portions of cable guide grooves 109 and 111 of the pulleys 101 and 103, and that the durability of the cable R is lowered owing to the contact therebetween.

Moreover, there is a fear that the contact between the cable R and each of the edge portions of the cable guide grooves 109 and 111 causes a falling force to act upon the pulleys 101 and 103 thereby to generate resistance between the pulleys 101, 103 and shafts respectively supporting these pulleys.

SUMMARY OF THE INVENTION

The invention is accomplished in view of such problems of the conventional techniques. Accordingly, an object of the invention is to provide a cable guide structure for a window regulator, in which the guiding direction of each of cable guide grooves of pulleys is set in such a way as to coincide with the direction of an axis of a diagonally cabling portion, which is a linearly arranged part of a cable, thereby to enhance the durability of the pulleys and the cable without generating resistance between the cable and each of the pulleys even when the diagonally cabling portion is linearly arranged.

To achieve the foregoing object, according to the invention, there is provided a cable guide structure (hereunder referred to as a first cable guide structure) for a window regulator, which comprises moving elements for supporting a window panel, which are upwardly and downwardly slidably mounted on rails that are provided in such a way as to be parallel with each other and are each laterally curved and each extend upwardly and downwardly, cables, which are respectively connected to top and bottom portions of each of the moving elements and also connected to a drive unit and each have a rail cabling portion, which is extended along a corresponding one of the rails, and a diagonally cabling portion so that the diagonally cabling portions of the cables cross each other like a X-shape between the rails, and pulleys each having a cable guide groove, which is formed in a circumferential portion thereof, for guiding the cable. The pulleys are rotatably mounted on the mounting surface of the top portion of one of the rails and that of the bottom portion of the other rail. In this structure, the diagonally cabling portion of at least one of the cables is linearly arranged. Further, a direction of a tangent line, which extends along a plane of rotation of a corresponding one of the pulleys, at a contact point between the rail cabling portion of each of the cables is set in such a manner as to coincide with a direction of an axis of the rail cabling portion of a corresponding one of the rails. Furthermore, a direction of a tangent line, which extends along a plane of rotation of a corresponding one of the pulleys, at a contact point between the linearly and diagonally cabling portion of the cable and the cable guide groove of the corresponding one of the pulleys is set in such a manner as to coincide with a direction of an axis of the linearly and diagonally cabling portion of the cable.

According to the first cable guide structure of the invention, the guiding direction of the cable guide groove of the pulley coincides with the direction of an axis of the rail cabling portion of the cable. Moreover, the guiding direction of the cable guide groove of the pulley coincides with the direction of an axis of the linearly and diagonally cabling portion of the cable. Thus, the cable is let out only along the guiding direction of the cable guide groove. Consequently, the cable is prevented from coming in contact with the edge portion of the guide groove of the pulley. Moreover, wear is prevented from occurring on the edge portion. Further, the cables are not curved by the edge portions of the pulleys. Thus, the durability of the window regulator is enhanced. Furthermore, the cables do not touch the edges of the pulleys. Thus, the resistance generated between the pulleys and the shafts respectively supporting the pulleys is reduced. Moreover, a simple structure, according to which the pulleys are only inclined, enables the reliable guiding of the cables each having the arranging and cabling portions that are arranged in directions different from the direction along the planes of rotation of the pulleys. Consequently, the window regulator is simplified. Moreover, the diagonally cabling portion is linearly arranged between the pulleys. This enables the arrangement of the cable by using the shortest length thereof. Consequently, the cost of materials is reduced.

According to an embodiment (hereunder referred to as a second cable guide structure) of the first cable guide structure of the invention, the diagonally cabling portion of the cable is covered with an outer tube, both end portions of which are fixed to the rails.

According to the second cable guide structure of the invention, the diagonally cabling portion of the cable is covered with the outer tube, both end portions of which are fixed to the rails. Thus, the rails are connected to each other by the outer tube. Even before the window regulator is assembled to the door, the window regulator is integrated. Consequently, the management of components is facilitated. The assembling of the window regulator to the door is achieved only by assembling the integrated window regulator to the door. Thus, the assembling workability is improved.

DETAILED DESCRIPTION OF THE PREFERRED EMBODIMENTS

Figure 1:
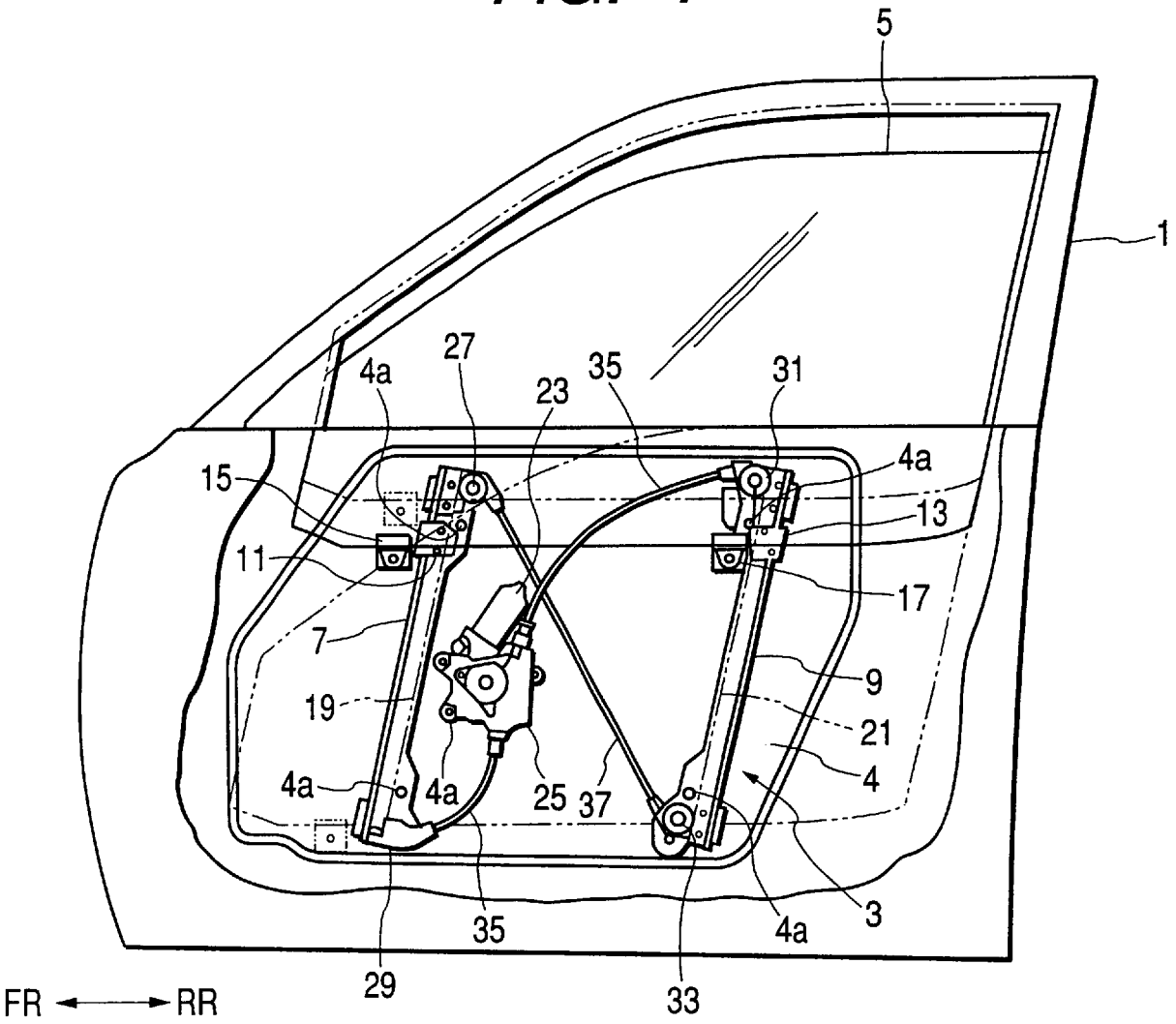
FIG. 1 is a front view illustrating an automotive door to which a window regulator according to an embodiment of the invention is mounted.

Hereinafter, an embodiment of the invention is described with reference the accompanying drawings. FIG. 1 shows a window regulator 3 to be mounted to a left-side door 1 of an automobile. In FIG. 1, the left-hand side thereof is the frontward side FR of the automobile. The upper side of the paper of this figure is an external side of the door 1 of the automobile. Incidentally, the window regulator 3 is preliminarily mounted to a base plate 4 with bolts 4*a*. The base plate 4, to which the window regulator 3 is mounted, is attached to the inner panel of the door 1 from the inside of the automobile.

The window regulator 3 has two rails 7 and 9, moving elements 11 and 13 slidably upward and downward on the rails 7 and 9, fastening/supporting portions 15 and 17, respectively secured to the moving elements 11 and 13, for supporting a window panel 5, and cables 19 and 21 that extend along the rails 7 and 9 and cross each other like a X-shape between the rails 7 and 9. Further, the rails 7 and 9 are extended upward and downward and laterally curved and frontwardly and rearwardly placed in parallel with each other. Moreover, the rails 7 and 9 are placed in parallel to a direction, in which the window panel 5 moves up and down, so that upper parts thereof are slightly displaced in a rearward direction RR and inclined toward the back of the automobile. Furthermore, end portions of each of the cables 19 and 21 are connected to the moving elements 11 and 13 by known means (not shown).

Figure 2:
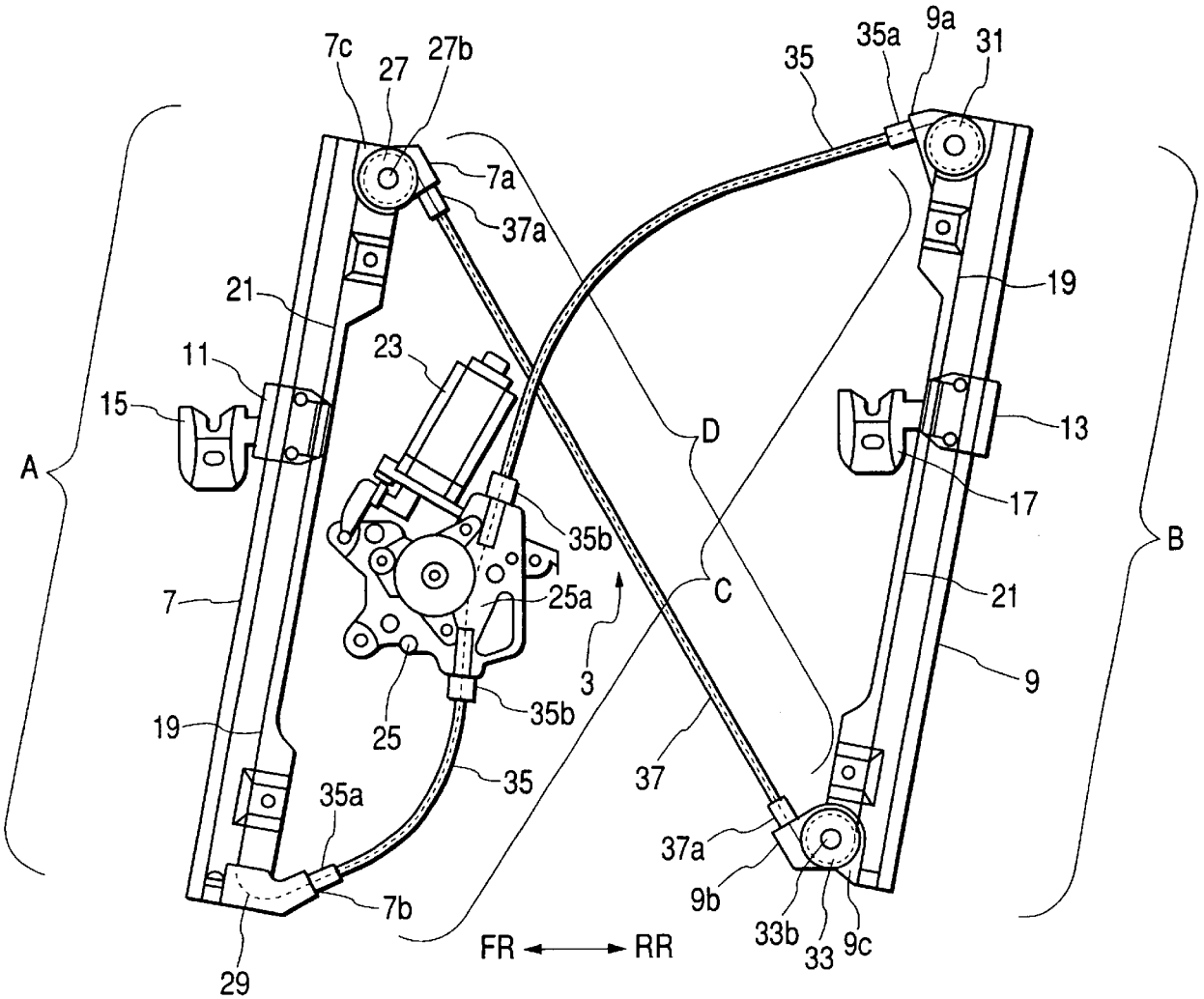
FIG. 2 is an enlarged view illustrating a primary part of the window regulator shown in FIG. 1.

One cable 19 of the cables is arranged in such a way as to be guided by a cable guide 29 at the bottom portion of the rail 7 placed at the front side FR of the automobile, and as to be guided by a pulley 31 at the top portion of the rail 9 placed at the rear side RR thereof. Further, the cable 19 is connected to a drive unit 25, which has a motor unit 23, in a second diagonally cabling portion C (see FIG. 2) provided between the cable guide 29 and the pulley 31. The other cable 21 is arranged in such a way as to be guided by a pulley 27 at the top portion of the rail 7 placed at the front side FR of the automobile, and as to be guided by a pulley 33 at the bottom portion of the rail 9 placed at the rear side RR thereof.

Thus, parts of the cables 19 and 21 constitute a rail cabling portion A (see FIG. 2) upwardly and downwardly arranged along the rail 7 between the pulley 27 and the cable guide 29 provided at the front side FR of the automobile, and also constitute a rail cabling portion B (see FIG. 2) upwardly and downwardly arranged along the rail 9 between the pulleys 31 and 33 provided at the rear side RR thereof. The moving elements 11 and 13 are placed in the rail cabling portions A and B. Further, a part of the cable 19 constitutes a second diagonally cabling portion C (see FIG. 2) to be slacked and arranged between the pulley 31 and the cable guide 29. A part of the cable 21 constitutes a first diagonally cabling portion D (see FIG. 2) linearly provided between the pulleys 27 and 33. These diagonally cabling portions C and D arranged like a X-shape in such a way as to cross each other in a central potion.

Parts of the second diagonally cabling portion C, which are respectively provided between the cable guide 29 and the drive unit 25 and between the pulley 31 and the drive unit 25, are covered with outer tubes 35. Fixing portions 35*a* are engaged with a bottom mounting portion 7*b* of the rail 7 provided at the front side FR of the automobile and a top mounting portion 9*a* of the rail 9 provided at the rear side RR thereof, respectively. Furthermore, fixing portions 35*b* of the outer tubes 35 are engaged with mounting portions 25*a* of the drive unit 25.

The first diagonally cabling portion D, which is a linear part of the cable 21, is covered with an outer tube 37. Fixing portions 37*a* of the outer tube 37 are engaged with a top mounting portion 7*a* of the rail 7 provided at the front side FR of the automobile and a bottom mounting portion 9*b* of the rail 9 provided at the rear side RR thereof, respectively.

Figure 3:
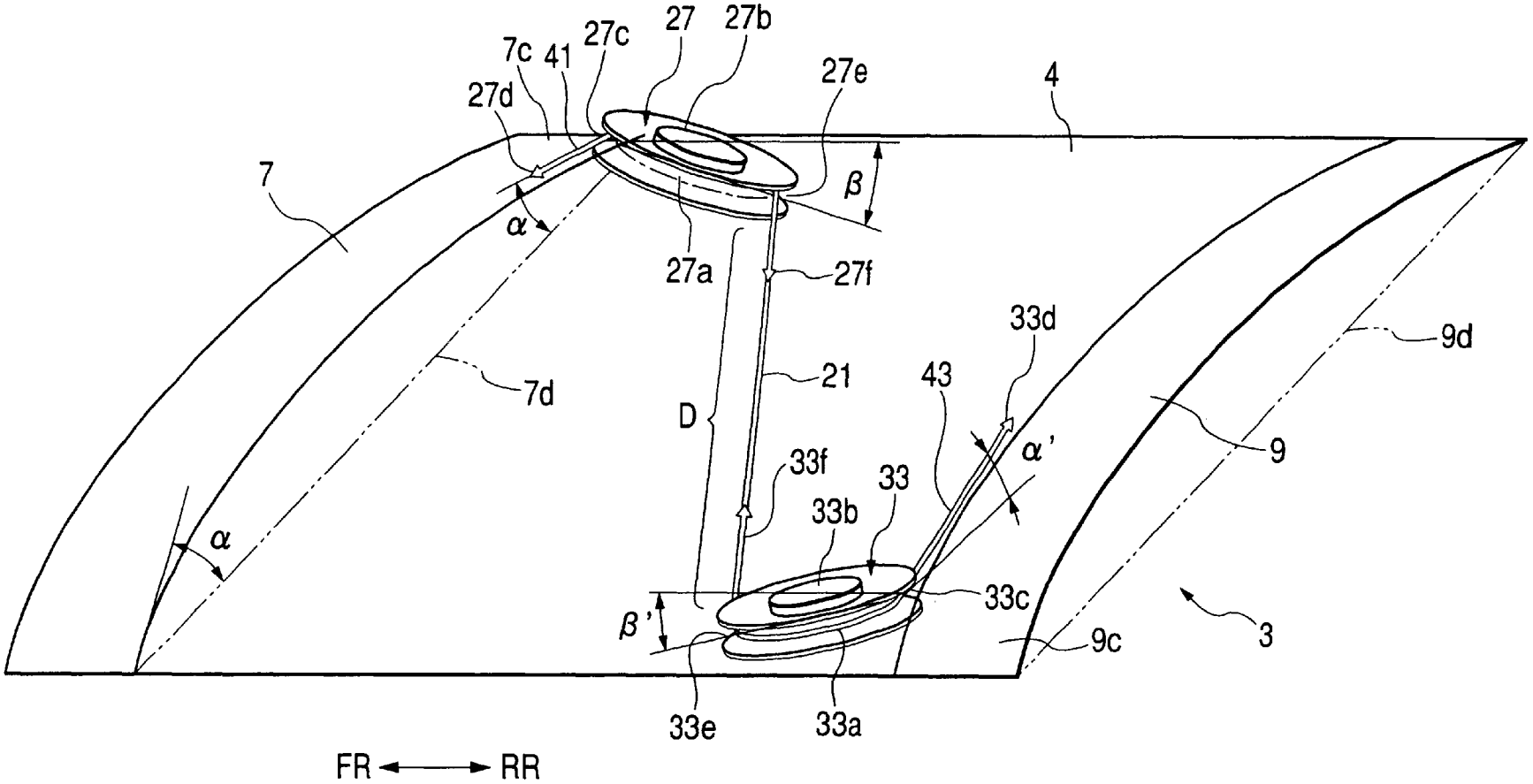
FIG. 3 is a perspective view illustrating an inclined state of each of pulleys of the window regulator shown in FIG. 2.
Figure 4:
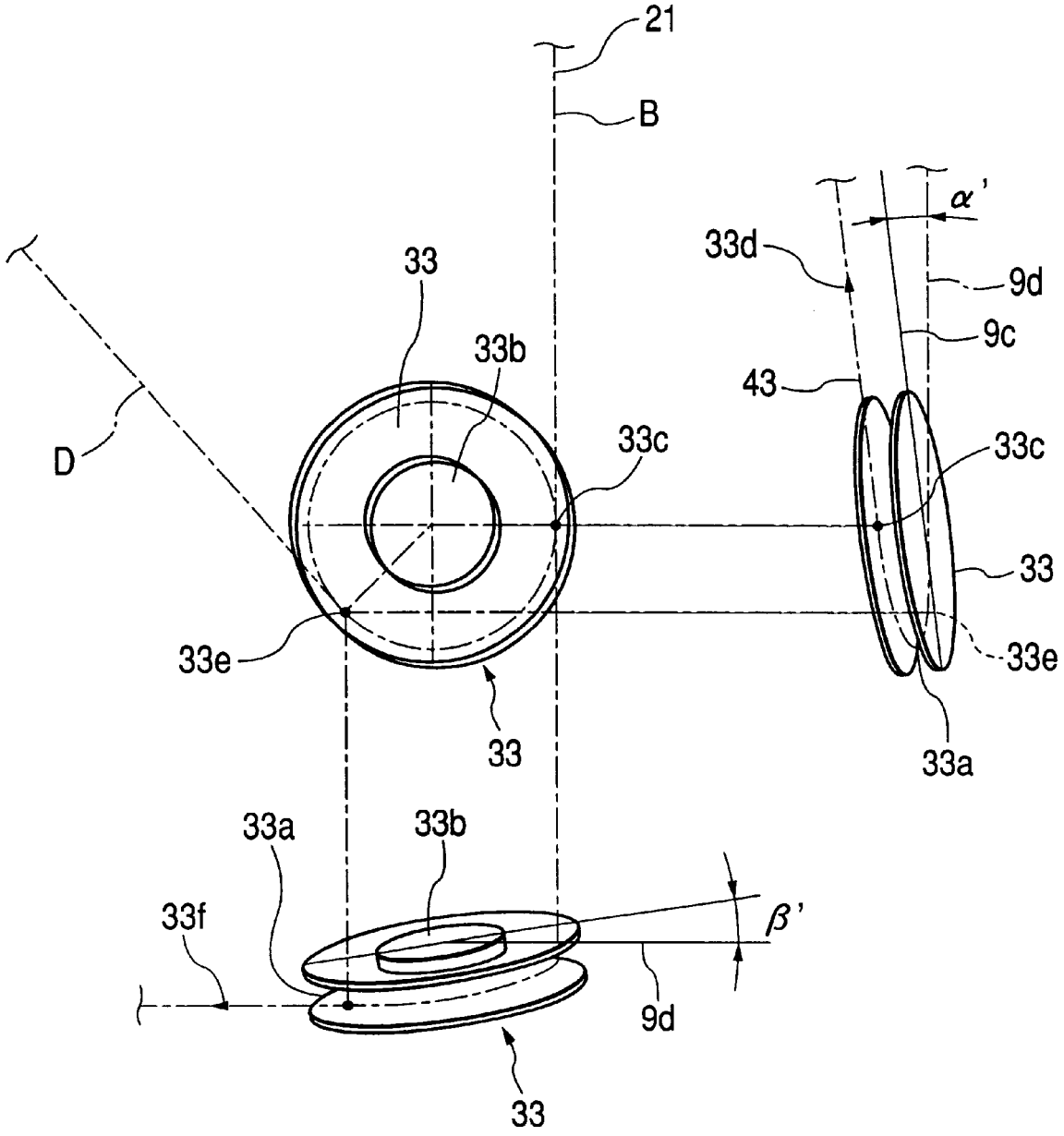
FIG. 4 is a view illustrating the inclined state of the pulley of the window regulator, the lower part of the figure is a bottom view illustrating the pulley; and the left part of the figure is a side view illustrating the pulley.
Figure 5:
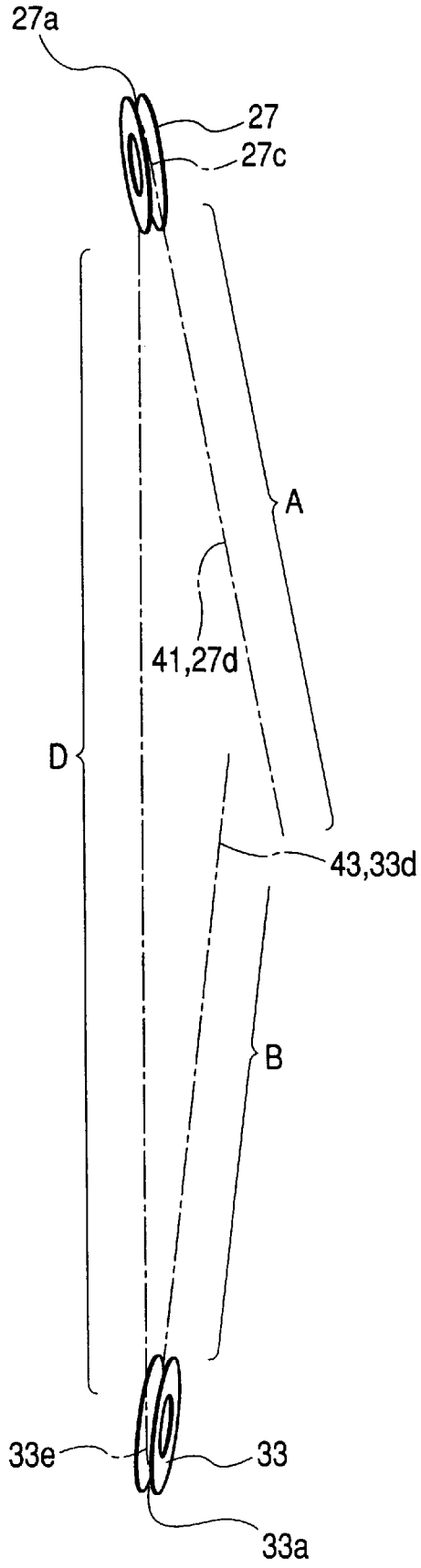
FIG. 5 is a view illustrating the inclined state of each of the pulleys of the window regulator and taken from a front side of a door.
Figure 6:
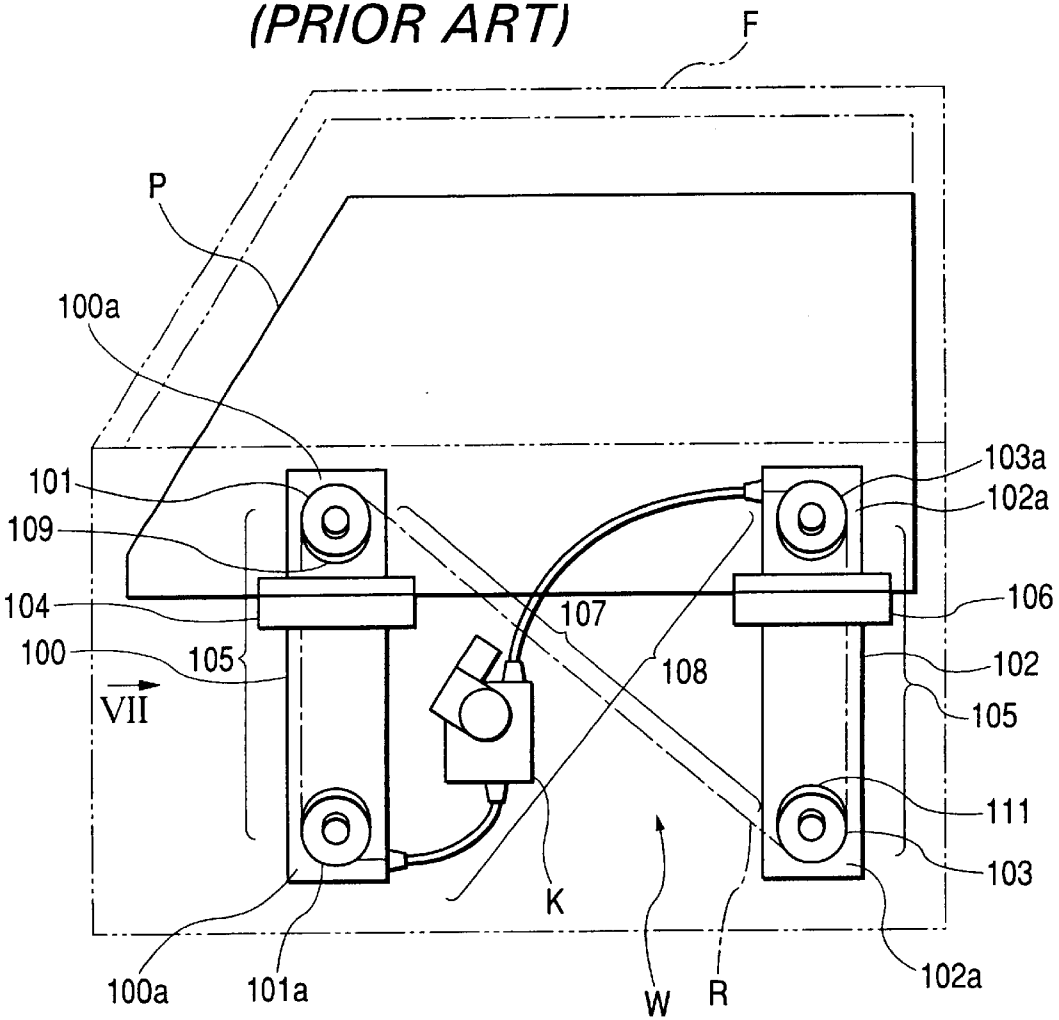
FIG. 6 (PRIOR ART)
FIG. 6 is a view illustrating a conventional window regulator and corresponding to FIG. 1.
Figure 7:
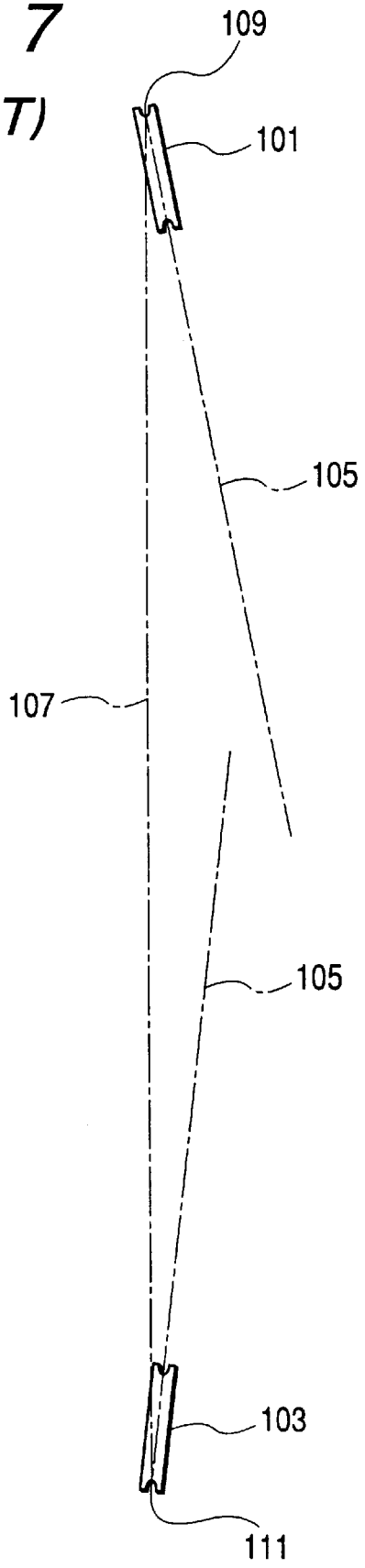
FIG. 7 (PRIOR ART)
FIG. 7 is a view illustrating the inclined state of each of the pulleys of the window regulator shown in FIG. 6, and taken from a front side of a door.

Supporting structures for the pulleys 27 and 33 are described hereinafter with reference to FIGS. 3 to 5. FIG. 3 is a perspective view schematically illustrating inclined states of the pulley 33 of the window regulator 3. FIG. 4 illustrates the inclined states of the pulley 33 of the window regulator 3, and taken from three directions, respectively. FIG. 5 is a side view illustrating the inclined state of each of the pulleys 27 and 33 of the window regulator, and taken from the front side FR of the automobile toward the rear side RR thereof.

The pulley 27 is rotatably supported a shaft 27*b* on a pulley mounting surface 7*c* of the top portion of the rail 7 provided at the front side FR of the automobile. Moreover, the pulley 33 is rotatably supported by a shaft 33*b* on a pulley mounting surface 9*c* of the bottom portion of the rail 9 provided at the rear side RR thereof.

As shown in FIG. 3, the pulley mounting surfaces 7*c* and 9*c* are formed on surfaces uniformly and respectively curved at tilt angles αand α' with respect to imaginary reference surfaces 7*d* and 9*d* including imaginary straight segments drawn between the top and bottom portions of the rail 7, which is provided at the front side FR of the automobile, and the rail 9 provided at the rear side RR thereof. Then, the pulleys 27 and 33 are mounted along the pulley mounting surfaces 7*c* and 9*c* inclined at the tilt angles α and α', respectively. Each of the rail cabling portions A and B is arranged at contact points 27*c* and 33*c* of cable guide grooves 27*a* and 33*a* from a directions along tilting lines 41 and 43 respectively extending toward top parts of the curved portions of the rails 7 and 9. That is, the center axis of each of the rail cabling portions A and B of the cables 19 and 21 coincides with the cable guide grooves 27*a* and 33*a* of the pulleys 27 and 33.

The first diagonally cabling portion D is set in such a manner as to linearly extend from each of the other contact points 27*e* and 33*e* of the pulleys 27 and 33, toward which a corresponding one of the pulleys 27 and 33 is turned by a corresponding turning angle β or β' around a corresponding one of the tilting lines 41 and 43 employed as axes of turn. Each of the pulleys 27 and 33 is turned around a corresponding one of shafts 27*b* and 33*b* respectively inclined to the reference surfaces 7*d* and 9*d*. Thus, the direction of each of tangent lines 27*f* and 33*f* respectively extending along the planes of rotation of the pulleys 27 and 33 changes to a diagonal direction with respect to the longitudinal direction of a corresponding one of the rail 7 at the front side FR and the rail 9 at the rear side RR.

The directions of the tangent lines 27*f* and 33*f*, which are at the sides of the first diagonally cabling portion D, of the planes of rotation of the pulleys 27 and 33 coincide with each other. The first diagonally cabling portion D is enabled to be linearly arranged. To set the directions of the tangent lines 27*f* and 33*f* of the planes of rotation of the pulleys 27 and 33 in such a way as to coincide with each other, the turning angles β and β' of the pulleys 27 and 33, that is, the bending angles β and β' of the pulley mounting surfaces 7*c* and 9*c* are adjusted.

Next, an operation of this embodiment is described below.

Thus, in the cable guide structure according to the invention, the directions of the tangent lines 27*d* and 33*d*, which extend along the planes of rotation of the pulleys 27 and 33, at the contact point 27*c* between the rail cabling portion A and the cable guide groove 27*a* and the contact point 33*c* between the rail cabling portion B and the cable guide groove 33*a* are set in such a way as to coincide with the directions of axes of the rail cabling portions A and B, respectively. Moreover, each of the directions of the tangent lines 27*f* and 33*f*, which extend along the planes of rotation of the pulleys 27 and 33, at the contact point 27*e* between the first linearly and diagonally cabling portion D and the cable guide groove 27*a* and the contact point 33*e* between the cabling portion D and the cable guide groove 33 is set in such a manner as to coincide with the direction of an axis of the first diagonally cabling portion D.

Thus, even when the rail cabling portion A and the first diagonally cabling portion D of the cable 21, which differ in arranging direction from each other, are wound around the pulley 27, the cable guide structure of the invention enables the setting of the direction of an axis of each of the rail cabling portion A and the first diagonally cabling portion D of the cable 21 in such a way as to coincide with the direction of the guiding direction of the cable guide groove 27*a* of the pulley 27. Furthermore, the cable guide structure of the invention also enables the setting of the direction of an axis of each of the rail cabling portion B and the first diagonally cabling portion D of the cable 21 in such a way as to coincide with the direction of the guiding direction of the cable guide groove 33*a* of the pulley 33.

Thus, the driving force of the drive unit 25 enables the cable 19 to draw and cause the moving element 13 to move up and down along the rail 9 provided at the rear side RR of the automobile.

Even in the case that the first diagonally cabling portion D is linearly arranged at that time, the guiding direction of the cable guide grooves 27*a* and 33*a* of the pulleys 27 and 33 coincides with the direction of an axis of the first diagonally cabling portion D. Thus, the cable 21 is not let out in the directions of axes of the rail cabling portions A and B and the first diagonally cabling portion D along the planes of rotation of the pulleys 27 and 33. Consequently, the cable 21 is prevented from coming in contact with the edge portions of the cable guide grooves 27*a* and 33*a* of the pulleys 27 and 33.

Further, the cable 21 is not curved by the edge portions of the cable guide grooves 27*a* and 33*a* of the pulleys 27 and 33. Thus, the durability of the window regulator is enhanced.

Furthermore, falling forces due to the contact between the cable 21 and each of the edge portions of the cable guide grooves 27*a* and 33*a* of the pulleys 27 and 33 do not act upon the pulleys. Therefore, the resistance generated between the pulleys 27, 33 and shafts 27*b*, 33*b* respectively supporting these pulleys is reduced. Consequently, an operation of the window regulator 3 is smoothly performed.

Further, the window regulator 3 does not need a complex structure. A simple structure, according to which the pulleys 27 and 33 are only inclined, enables the reliable guiding of the cable 21 having the arranging and cabling portions that are arranged in different directions. Consequently, the window regulator 3 is simplified.

Moreover, the first diagonally cabling portion D is linearly arranged between the pulleys 27 and 33. This enables the arrangement of the cable 21 by using the shortest length thereof. Consequently, the cost of materials is reduced.

Further, the first diagonally cabling portion D of the cable 21 is covered with the outer tube 37, the both ends of which are fixed to the rails 7 and 9. Thus, the rails 7 and 9 are connected to each other by the outer tube 37. That is, even before the window regulator is assembled to the door 1, the window regulator 3 is integrated. Consequently, the management of components is facilitated. The assembling of the window regulator 3 to the door 1 is achieved only by assembling the integrated window regulator to the door 1. Thus, the assembling workability is improved.

When the invention is applied to a window regulator 3 of different dimension and shape, it is sufficient to set the bending angles of the pulley mounting portions 7*a* and 9*b* of the two rails 7 and 9 in such a manner as to suit the window regulator.

Although the cables 19 and 21 are driven by the driving force of the motor unit 23 in this embodiment, the invention is not limited to this manner. Needless to say, the invention is applicable to a window regulator adapted so that the cables 19 and 21 are driven by a manual driving force.

According to the first cable guide structure of the invention, the guiding direction of the cable guide groove of the pulley coincides with the direction of an axis of the rail cabling portion of the cable. Moreover, the guiding direction of the cable guide groove of the pulley coincides with the direction of an axis of the linearly and diagonally cabling portion of the cable. Thus, the cable is let out only along the guiding direction of the cable guide groove. Consequently, the cable is prevented from coming in contact with the edge portion of the guide groove of the pulley. Moreover, wear is prevented from occurring on the edge portion. Further, the cables are not curved by the edge portions of the pulleys. Thus, the durability of the window regulator is enhanced. Furthermore, the cables do not touch the edges of the pulleys. Thus, the resistance generated between the pulleys and the shafts respectively supporting the pulleys is reduced. Moreover, a simple structure, according to which the pulleys are only inclined, enables the reliable guiding of the cables each having the arranging and cabling portions that are arranged in directions different from the direction along the planes of rotation of the pulleys. Consequently, the window regulator is simplified. Moreover, the diagonally cabling portion is linearly arranged between the pulleys. This enables the arrangement of the cable by using the shortest length thereof. Consequently, the cost of materials is reduced.

According to the second cable guide structure of the invention, the diagonally cabling portion of the cable is covered with the outer tube, both end portions of which are fixed to the rails. Thus, the rails are connected to each other by the outer tube. Even before the window regulator is assembled to the door, the window regulator is integrated. Consequently, the management of components is facilitated. The assembling of the window regulator to the door is achieved only by assembling the integrated window regulator to the door. Thus, the assembling workability is improved.

What is claimed is:

1. A cable guide structure for a window regulator comprising:

rails aligned so as to be parallel with each other, each of said rails being laterally curved;

moving elements for supporting a window panel, slidably mounted on said rails;

a cable connected to said moving elements, said cable being moved by a drive unit, said cable being constituted by rail cabling portions provided along said rails and diagonally cabling portions crossing each other between said rails; and at least one pulley having a cable guide groove formed in a circumferential portion thereof for guiding said cable, said pulley being rotatably mounted on a mounting surface of at least one of said rails, wherein at least one of said diagonally cabling portions is linearly arranged, a direction of a tangent line of said pulley at a first contact point of said rail cabling portion with said cable guide groove in a plane of rotation coincides with an axial direction of said cable in said rail cabling portion at said first contact point thereof, and a direction of a tangent line of said pulley at a second contact point of said linearly and diagonally cabling portion with said cable guide groove in a plane of rotation coincides with an axial direction of said cable in said linearly and diagonally cabling portion at said second contact point thereof.

2. A cable guide structure for a window regulator according to claim 1, wherein said diagonally cabling portion is covered with an outer tube, both end portions of which are fixed to said rails.

3. A cable guide structure for a window regulator according to claim 1, further comprising a base plate mounting said window regulator including said cable arranged between said pair of said rails and said driving unit for moving said cable, said base plate being adapted to be attached to a door inner panel.

* * * * *